US005252353A

United States Patent [19]

DiGiulio et al.

[11] Patent Number: 5,252,353

[45] Date of Patent: Oct. 12, 1993

[54] ENVELOPE FLAP MOISTENER HAVING APPLICATOR PRE-POSITIONING

[75] Inventors: Peter C. DiGiulio, Fairfield; Edilberto I. Salazar, Brookfield, both of Conn.

[73] Assignee: Pitney Bowes Inc., Stamford, Conn.

[21] Appl. No.: 796,501

[22] Filed: Nov. 22, 1991

[51] Int. Cl.[5] ..... B05D 1/02

[52] U.S. Cl. ..... 427/8; 427/424; 118/669; 118/680; 118/681; 118/323; 118/324

[58] Field of Search ..... 427/8, 424; 118/669, 118/323, 680, 681, 324

[56] References Cited

U.S. PATENT DOCUMENTS 3,594,211 7/1971 Drum ..... 118/669

4,873,941 10/1989 O'Dea ..... 118/324

*Primary Examiner*—Shrive Beck

*Assistant Examiner*—Katherine A. Bareford

*Attorney, Agent, or Firm*—Charles G. Parks, Jr.; Melvin J. Scolnick

[57] ABSTRACT

In a moistener for moistening a mixed succession of objects of a substantially limited number of different height profiles and having a nozzle, methods for controlling movement of the nozzle are presented. These methods include a nozzle initialization process, a nozzle pre-positioning process and a nozzle holding process.

4 Claims, 7 Drawing Sheets

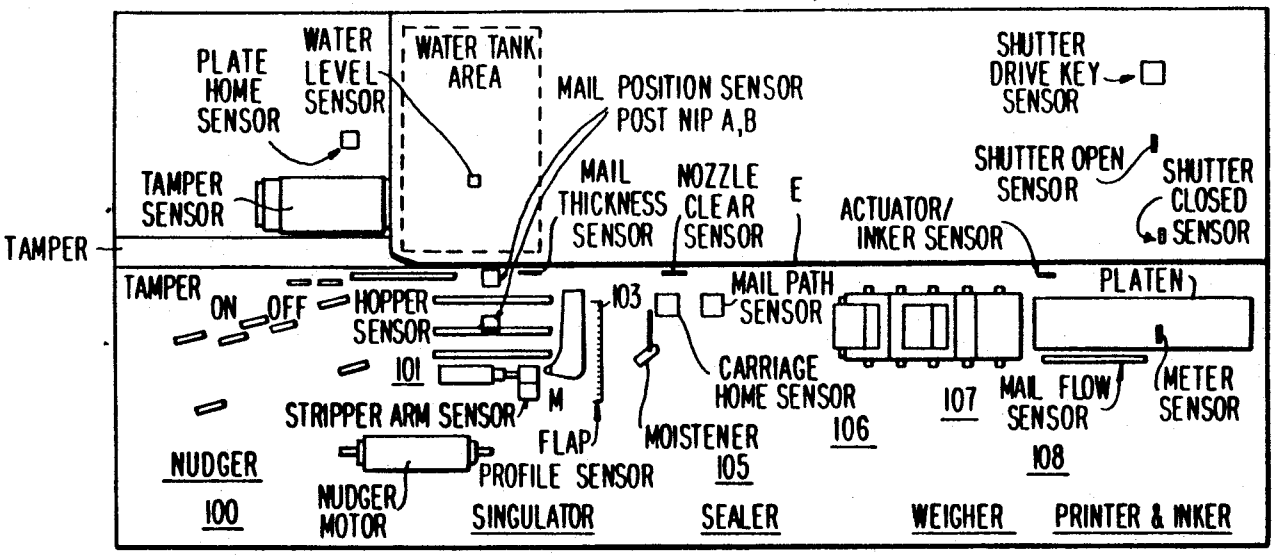
FIG. 2
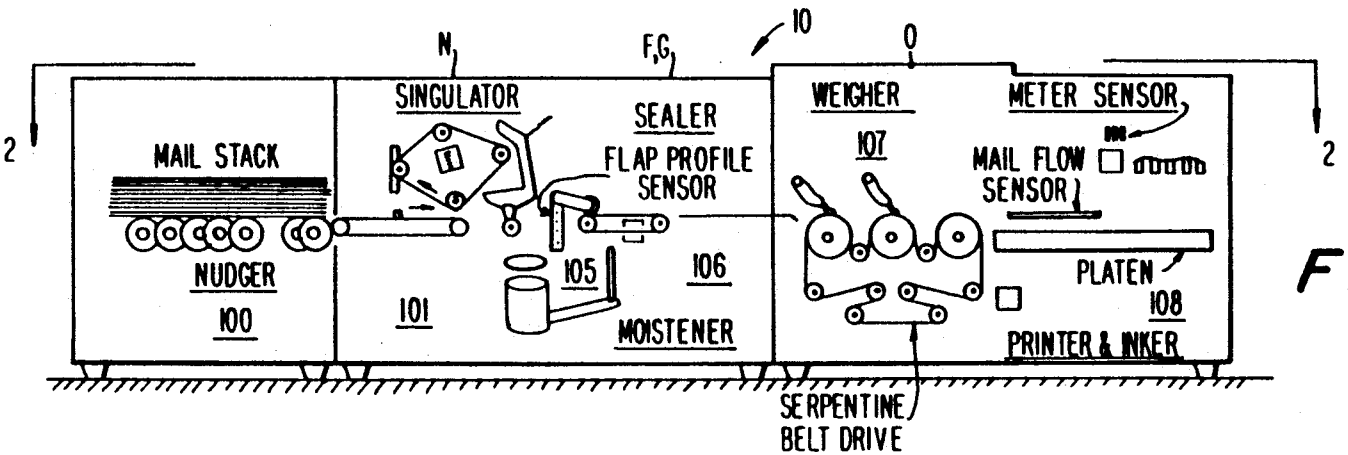

ENVELOPE FLAP MOISTENER HAVING APPLICATOR PRE-POSITIONING

BACKGROUND OF THE INVENTION

The present invention relates to a moistener nozzle control system. More particularly, the present invention relates to a method for positioning a nozzle in a moistener of a mailing machine.

Modern mail-handling machines which seal envelopes typically include a moistener for moistening the envelope flap. After moistening, the flap is then sealed before it is passed on to a scale and postage meter. Mail-handling machines employ a wide variety of moisteners.

Bach et al. U.S. Pat. No. 2,944,511 shows an envelope flap moistener which includes a brush that is brought into contact with the flap. A disadvantage of this particular type of moistener is that it requires physical contact between the brush and the flap to be moistened. Furthermore, it is "non-selective" in that it moistens the entire flap without distinguishing between the gummed and non-gummed regions of the flap.

Fassman et al. U.S. Pat. No. 4,926,787 shows another non-selective and contact-requiring envelope flap moistener. Moistening is provided by a pad made of a fluid wicking material.

Lupkas U.S. Pat. No. 3,911,862 shows a non-contact envelope flap moistener. It includes a jet or nozzle which sprays a moistening fluid upon the gum of the flap. The spray is applied as the envelope moves past the nozzle. A photocell sensor controls the application of the spray by sensing the passage of the envelope and/or its flap. The spray is applied in tiered segmented fashion to the flap in order to moisten substantially the entire gummed surface of the flap. The segmented spray is achieved either by (1) moving the nozzle, or (2) providing a selective spraying using a pair of closely spaced nozzles.

O'Dea et al. U.S. Pat. No. 5,007,371 also shows a non-contact envelope flap moistener employing a nozzle. This moistening arrangement includes a sensor arrangement for sensing the width of an envelope flap and a control arrangement for controlling the position of the moistener.

In general, moisteners which employ a motor-controlled nozzle include a device for detecting the presence of an envelope flap. The presence-detecting device is used to turn a motor on and off in order to move and position the nozzle so that it will selectively spray only on the gummed regions of the envelope flap. In modern mail-handling machines, which process envelopes moving at high speeds, the motor-controlled nozzle must be able to quickly respond to the presence-detecting device to assure proper moistening of a fast-moving envelope flap.

For a given envelope speed through a mailing machine, the response time of the motor-controlled nozzle limits the size of the envelope flap under which a moistener can be used. If the response time is too slow, the nozzle cannot be re-positioned quickly enough in order to accurately follow the gummed region of the envelope flap. Under these conditions, the nozzle would not be able to get to the gum line of large envelope flaps until well past the beginning of the envelope. This can result in significant parts of large envelope flaps that remain unsealed.

The difficulty in sealing large envelope flaps could be minimized, to some extent, by optimizing the moistener nozzle control system so that it can perform better with larger envelope flaps. However, it is desirable that a moistener nozzle control system be able to handle a mixed succession of a random mix of both large and small envelope flaps without the need for manual intervention or sorting of envelopes. If a moistener nozzle control system is optimized solely for large envelope flaps this might negatively impact the sealing of small envelope flaps.

When a motor-controlled nozzle is required to move quickly for re-positioning, the motor must normally be controlled under high-torque conditions. Operating a nozzle motor continuously, especially under high-torque conditions, may have disadvantages. Because the average motor temperature is directly related to the amount of time that the motor is operated, the longer that a motor is operated, the higher its temperature will be. In addition, operation under high-torque conditions further increases the temperature of the motor. Reducing average motor temperature results in a savings in motor cost and an increase in motor lifetime. Furthermore, the amount of time that a nozzle motor is operated determines the motor power supply requirements. Reducing the amount of time that a motor is operated, especially under high-torque conditions, reduces power consumption and therefore power supply cost.

In view of the above, it would be desirable to be able to provide a moistener nozzle control system for a moistener that is contactless, selective, and yet is capable of operating in a high-speed environment.

It would also be desirable to be able to provide such a moistener nozzle control system which has a fast enough response time that envelopes with large flaps can be properly moistened.

It would further be desirable to be able to provide a moistener nozzle control system that can handle a mixed succession of a random mix of both large and small envelope flaps without the need for manual intervention or sorting of envelopes.

It would still further be desirable to be able to provide a moistener nozzle control system which does not require a nozzle motor to be operated as frequently, especially under high-torque conditions, so that the average temperature and power consumption of the motor can be reduced.

SUMMARY OF THE INVENTION

It is an object of this invention to provide a moistener nozzle control system for a moistener that is contactless, selective, and yet is capable of operating in a high-speed environment.

It is also an object of this invention to provide a moistener nozzle control system which has a fast response time that envelopes with large flaps can be properly moistened.

It is a further object of this invention to provide a moistener nozzle control system that can handle a mixed succession of a random mix of both large and small envelope flaps without the need for manual intervention or sorting of envelopes.

It is a still further object of this invention to provide a moistener nozzle control system which does not require a nozzle motor to be operated as frequently, especially under high-torque conditions, so that the average temperature and power consumption of the motor can be reduced.

In accordance with the present invention, there is provided a method for controlling movement of a nozzle in a moistener, the moistener being for moistening a mixed succession of objects of a substantially limited number of different height profiles, each of the objects having a first end and a second end, each of the height profiles having a terminal height adjacent the first and second ends, the moistener having the nozzle at a fixed lateral position, means for moving the objects in a downstream direction, a sensor upstream of the nozzle for measuring the heights of the objects, means for moving the nozzle in the direction of the heights of the objects and means for measuring movement of the objects by said conveyor. The method includes a nozzle initialization process for positioning the nozzle, during moistener rest periods, to an intermediate rest height position that is greater than the smallest flap height in the mixed succession of envelope but less than the largest flap height in the succession. The method also includes a nozzle pre-positioning process which pre-positions the nozzle prior to an envelope flap actually arriving at the fixed lateral position of the nozzle. Furthermore, the method includes a nozzle holding process for holding the nozzle to a predetermined flap height after the nozzle has tracked an envelope flap profile and before a subsequent envelope flap approaches the fixed lateral position of the nozzle.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 1 is a simplified side view of a mailing machine which may incorporate an embodiment of the moistener nozzle control system of the present invention;

FIG. 2 is a top view of the mailing machine of FIG. 1, taken from line 2—2 of FIG. 1;

DETAILED DESCRIPTION OF THE INVENTION

Figure 3:
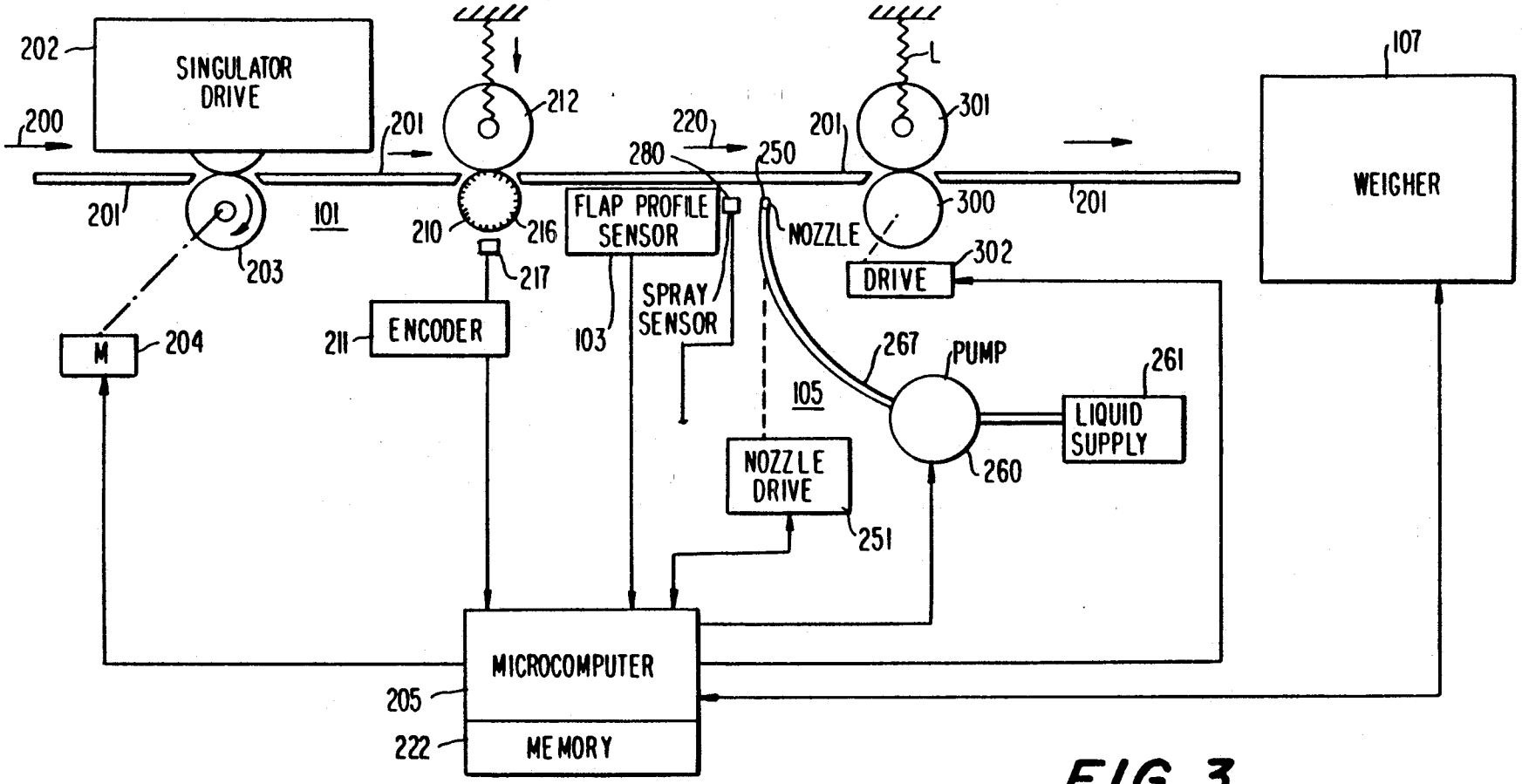
FIG. 3 is a simplified diagram of an embodiment of the moistener nozzle system with which the present invention may be used.

FIGS. 1 and 2 illustrate a mailing machine of a type which can incorporate the moistener nozzle control system of the present invention. As shown, mail is stacked on mailing machine 10 in stacking region 100. The mail, which is typically a stack of envelopes, is then fed from stacking region 100 to singulator 101 for separation into individual pieces. Following the separation of individual envelopes, the envelopes pass flap profile sensor 103 which provides electrical signals for detecting the profile of the individual envelope flaps which are to be moistened and then sealed. A representation of these electrical signals are stored in a memory (not shown in FIGS. 1-2) and correspond to the profile of the envelope flap. In accordance with the present invention, the profile data is subsequently used to control movement of the moistener nozzle 250 for moistening and sealing the envelope. Nozzle 250 is moved to spray water or other liquid on the gummed region of the envelope flap, as discussed in more detail below. Following moistening, the envelope flaps are sealed in sealing region 106, and then directed to weigher 107. Following weighing, postage indicia may be printed on the envelopes by a printer and inker assembly 108.

FIG. 3 illustrates a preferred embodiment of a moistener under which the moistener nozzle control system of the present invention may be used. As illustrated in FIG. 3, envelopes move in the direction of arrows 200 along drive deck 201, which may be horizontal or slightly inclined. The envelopes are then separated into individual pieces at singulator drive 202, including driver roller 203 driven by motor 204. Motor 204 is controlled by microcomputer 205 as discussed below. Of course drive belts may be used in place of rollers for transporting mail pieces along the mail deck 201. Prior to being directed to the singulator, the flaps of the individual envelopes are opened by any conventional technique (not shown in FIG. 3), so that the flaps extend downward through a slot of deck 201.

In accordance with the present invention, it is most desirable to know precisely the location of an envelope as it moves through moistener 105. It has been found that the rotational or other movements in singulator drive 202 are not sufficiently accurate to determine the position of an envelope, in view of the slippage which normally occurs in the singulator. Accordingly, encoding roller 210 is provided downstream of singulator drive 202. Envelopes are pressed against encoding roll 210 by bias roller 212. The rotation of encoding roller 210, which activates encoder 211, provides a train of electrical pulses to microcomputer 205. These pulses correspond to the instantaneous rate of rotation of roller 210. Encoding roller 210 may be provided with suitable conventional markings 216 about its periphery adapted to be sensed by photo sensor 217, which supplies the required pulses to encoder 211 as each marking is sensed. These markings are precisely placed so that counting them enables an accurate determination of envelope location and speed. Of course, other techniques may be employed for supplying signals corresponding to the rotation of encoder roller 210 to microcomputer 205.

Envelopes emerging from the nip of encoder roller 210 and bias roller 212 are directed to flap profile sensor 103. This sensor outputs signals corresponding to the instantaneously-sensed flap height of an envelope flap passing thereby to microcomputer 205, for storage in memory 222. Sensor 103 is preferably adapted to sense the flap height at predetermined longitudinally spaced-apart displacement points. For example, sensor 103 may read the flap height after receipt of predetermined numbers of pulses from encoder 211. Preferably, flap profile sensor 103 is of the type disclosed in U.S. Pat. No. 4,924,106, which has a resolution of approximately 0.085 inches over a field approximately 4.0 inches wide, but other sensors using other increments may be used.

Downstream from flap profile sensor 103, nozzle 250 of moistening system 105 is moved by nozzle drive 251 under the control of microcomputer 205, to position the nozzle at a predetermined position in accordance with the present invention. The position of the nozzle is controlled as a function of the data stored in memory 222, as discussed below.

Microcomputer 205 also controls pump 260 for directing a determined quantity of liquid from liquid supply 261 to nozzle 250 by way of tube 267. Thus, microcomputer 205 receives data corresponding to the length of the area to be moistened on an envelope from flap profile sensor 103. Further data may be stored in memory 222 corresponding to standard envelope flaps so that microcomputer 205 can determine the shape of the flap to be moistened on the basis of a minimum number of initial sensings of the envelope flap width. This information may be employed by microcomputer 205 to control the quantity of liquid to be pumped by pump 260.

A sensor 280 may be provided at a position adjacent nozzle 250. Prior to controlling nozzle drive 251, in preparation for moistening of an envelope flap, microcomputer 205 controls pump 260 to emit a jet of liquid from nozzle 250 for a predetermined time. Sensor 280 is positioned so that it intercepts this jet of liquid, either by transmission or reflection. This signals microcomputer 205 that nozzle 250 is functioning properly and that liquid supply 261 is adequately filled.

Downstream of moistener 105, an envelope is directed between driver roller 300 and its respective backup roller 301. Driver roller 300 is controlled by motor drive 302 under the control of microcomputer 205. Driver roller 300 is spaced from driver roller 203 a distance that is less than the smallest expected envelope lengths so that the envelope is continually positively driven. It will be observed, however, that due to the spacing between encoder roller 210 and driver roller 300, encoder 211 will not provide timing pulses corresponding to the movement of the envelope after the trailing edge of the flap leaves the nip of encoder roller 210. A sensor (not shown in FIG. 3) positioned adjacent the nip of encoder roller 210 is used to indicate when the envelope exits encoder roller 210. Beginning at this point, the movement of the envelope, for the purpose of positioning nozzle 250, is determined by microcomputer 205 based on the movement of roller 300, as measured by a suitable encoder (not shown). Because driver roller 300 does not form part of a singulator, it is not necessary to consider slippage between the motion of the envelope and the rotation of driver roller 300, and hence it is not necessary to provide an additional encoder wheel downstream of the moistener.

Figure 4A:
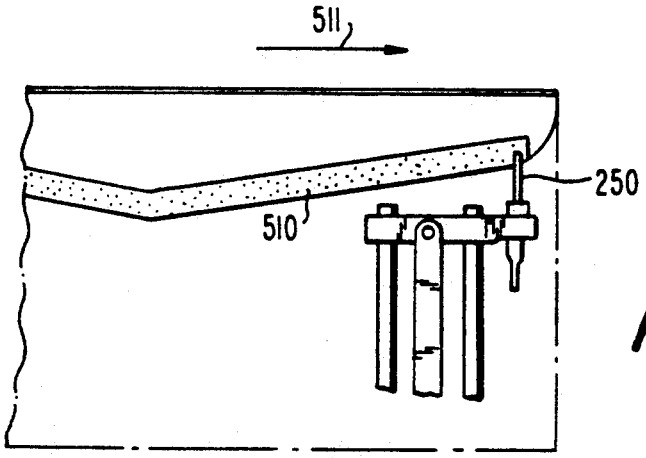
FIGS. 4A, 4B, and 4C illustrate sequential positions of an embodiment of the nozzle with which the present invention may be used, during the moistening of a flap.
Figure 4B:
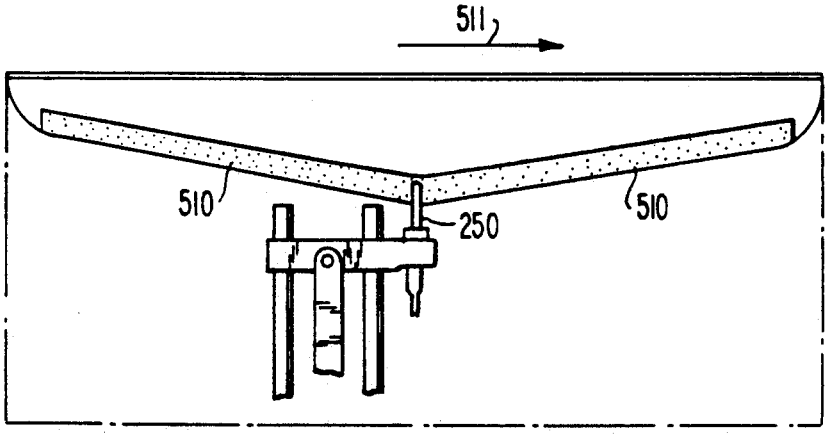
Figure 4C:
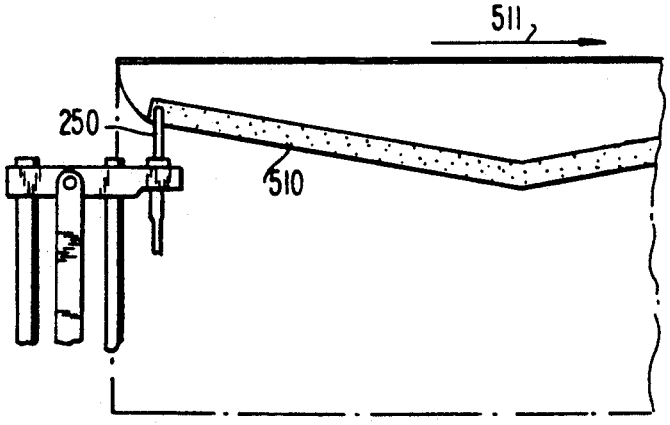

The moistener nozzle system of FIG. 3 is used to moisten an envelope flap. FIGS. 4A–4C illustrate a situation where nozzle 250 substantially tracks gummed region 510 of an envelope as the envelope moves downstream through the moistener of a mailing machine. In order to achieve such a result, the control system of nozzle 250 must be accurate. As will be explained below, under certain conditions conventional control systems do not always produce a moistening profile that accurately tracks the gummed region of an envelope flap.

Figure 5:
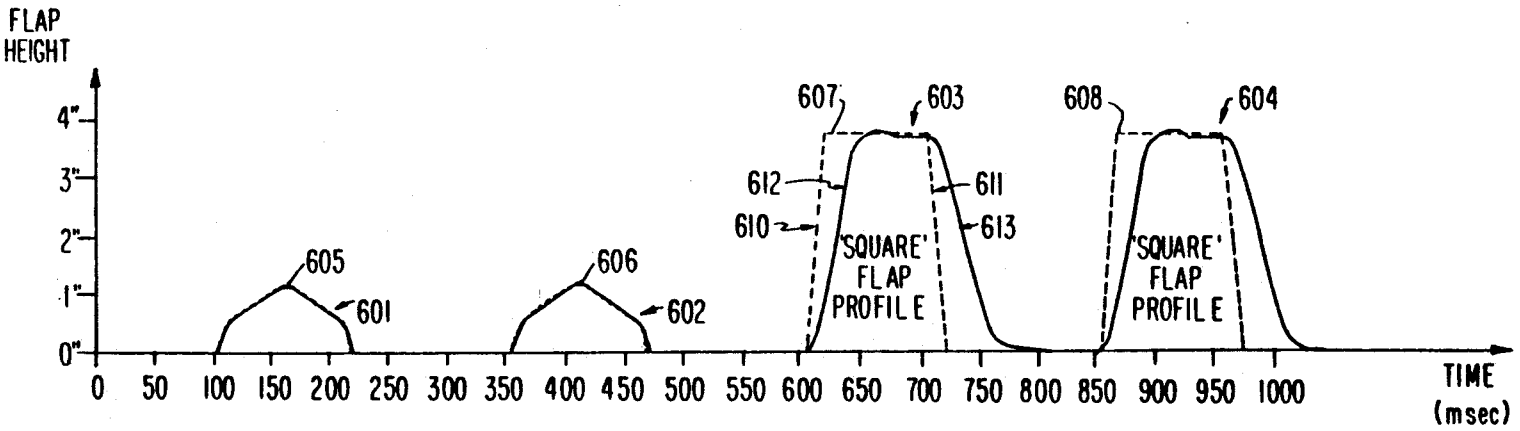
FIG. 5 is a graphic illustration that compares the moistening profiles of a mixed succession of four envelope flaps as they move through a conventional moistener in a mailing machine.

FIG. 5 qualitatively illustrates and compares the moistening profiles 601, 602, 603 and 604 of a mixed succession of four envelope flaps, having flap profiles 605, 606, 607 and 608, as the envelopes move through a moistener in a mailing machine which is controlled by a previously-known nozzle control system. As shown in FIG. 5, the mixed succession of four envelope flaps move through the moistener in about 1000 milliseconds. The dashed lines in FIG. 5 represent the actual envelope flap profile, whereas the solid lines represent the position of the nozzle when liquid is sprayed. Envelope flap profiles 605 and 606 are "triangular," with a maximum terminal height of approximately 1.25 inches at the center of the flap. Envelope flap profiles 607 and 608 are "square," with a maximum terminal height of approximately 3.75 inches at the center of the flap.

As can be seen in FIG. 5, at a time of approximately 110 milliseconds the downstream edge of a first "triangular" envelope having a flap profile 605 passes through the moistener. At this point in time the nozzle is at its initial rest position of zero inches. As the flap moves by the nozzle, the nozzle is able to respond quickly enough that the moistened profile 601 correlates well with the actual flap profile 605. After the first flap moves by the nozzle, the nozzle remains at its initial rest position of zero inches while it awaits a second envelope to approach the moistener. As shown in FIG. 5, if the second flap has a profile 606 similar to the first flap profile 605, then the nozzle will also be able to accurately track the second envelope. After second envelope flap 602 is spayed with liquid, the nozzle returns its initial rest position of zero inches and waits for a third envelope flap.

When the third envelope flap, having a "square" flap profile 607, approaches the nozzle, the nozzle can not be moved quickly enough to be able to accurately track the profile (see regions 610 and 611 of flap profile 607 in FIG. 5), because the flap height increases rapidly. This steep slope of flap profile 607 combined with the fact that the envelopes are moving through the moistener at a speed in excess of approximately 250 milliseconds per envelope, means that the nozzle must move at speeds beyond its capability to accurately track the flap profile. This results in a nozzle profile 603 that does not accurately track flap profile 607 (compare regions 612 and 613 to regions 610 and 611, respectively, for flap profile 607 in FIG. 5). However, when the slope of an envelope flap is not very steep, as is the case for flap profiles 605 and 606 in FIG. 5, the nozzle can accurately track the envelope flap profile (compare the dashed to solid lines for flap profiles 605 and 606 in FIG. 5). As discussed below, the present invention results in improved operation of moister nozzle control in the moistening of a mixed succession of envelope flaps.

In accordance with the present invention, microcomputer 205 of FIG. 3 is used to track the position of an envelope as it moves from encoder roller 210 to driver roller 300 past nozzle 250. Preferably, this tracking is in increments of 0.060 inches. Microcomputer 205 keeps track of the respective rotations of rollers 210, 300, which positively engage the envelope, thereby keeping track of the envelope position in response to roller increment. If desired, other tracking units besides 0.060 inches could be used in the present invention.

Preferably, flap profile sensor 103 is of the type disclosed in the above-reference U.S. Pat. No. 4,924,106.

Microcomputer 205 processes flap profile data from flap profile sensor 103 to generate a flap image table which is stored in memory 222. The flap image table is a table which correlates linear displacement distance along the envelope flap from the downstream edge of the envelope to be moistened with its corresponding flap height measured by flap profile sensor 103. Preferably, this table uses linear displacement distances in increments of 0.060 inches and flap heights in increments of 0.085 inches, although other increments can be used as well.

The flap image table is used in conjunction with the methods of the present invention in order to allow nozzle 250 to follow a moistened flap profile that accurately tracks the actual envelope flap profile. The methods of the present invention include a nozzle initialization process, a nozzle pre-positioning process and a nozzle holding process. These processes control the movement of a nozzle in envelope flap moisteners which process a mixed succession of envelope flaps with a random mix of flap height profiles.

The nozzle initialization process of the present invention initially positions the nozzle during time-out periods (while no envelope flaps are moving through the moistener) to a 1.5 inch "ready" position. As a result of this initialization process, if the first envelope flap to approach the nozzle is either smaller or larger than 1.5 inches, the nozzle will be in an "intermediate" rest position so that it can respond, on average, more quickly to either type of flap. Otherwise, if the nozzle were initially in the conventional zero inch rest position, then if the first envelope flap had a large width (e.g., 4 inches) the nozzle would initially have to be moved a large distance. This initialization process results in an improvement of the moistener nozzle control system response time so that more accurate moistener profiles can be obtained on a mixed succession of envelope flaps.

Figure 6A:
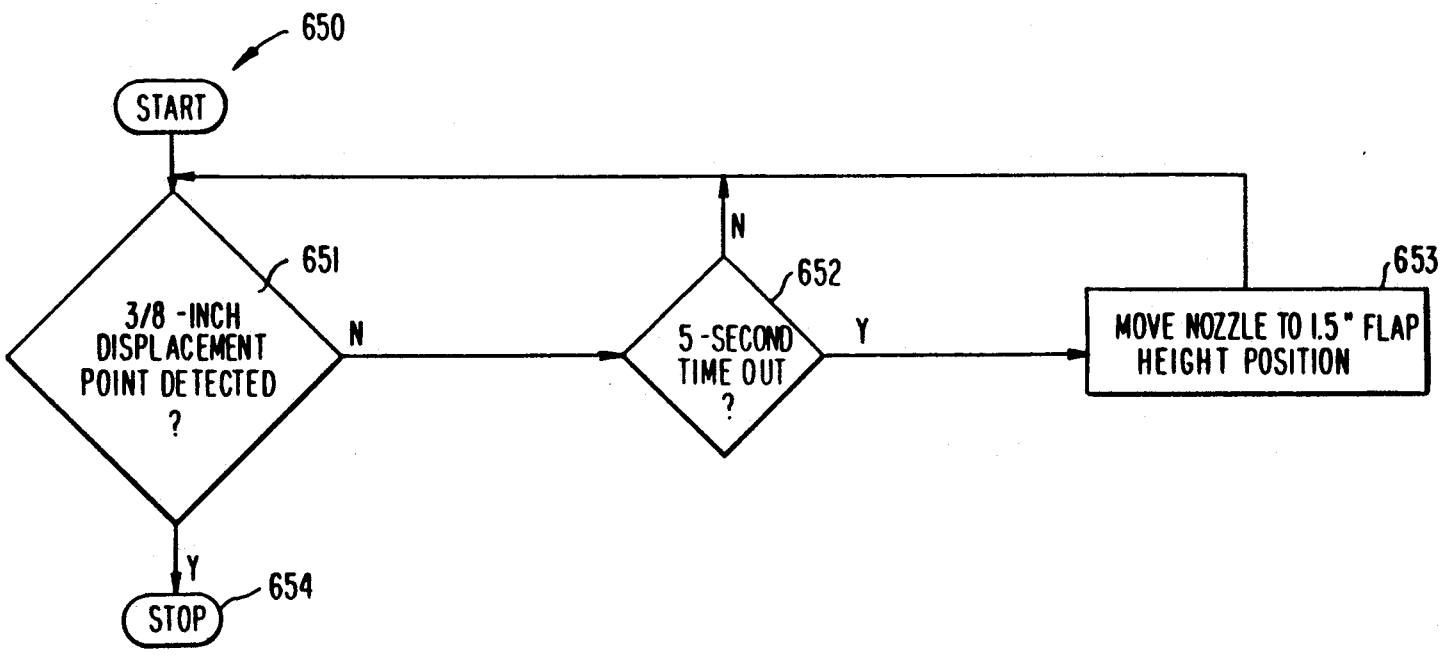
FIG. 6A is a flow diagram of an embodiment of the nozzle initialization process according to the present invention.

The nozzle initialization process of the present invention is diagrammed in FIG. 6A. The process starts at test 651 where it is determined whether or not an envelope flap has been detected and has been displaced laterally ¾-inch from its leading edge. If an envelope has been detected and has been displaced laterally ¾-inch, then the process returns at 654 and other processes that allow moistening to occur are initiated. However, before returning, although not shown in FIG. 6A, when an envelope has been laterally displaced ¾-inch, the system measures the "¾-inch displacement height," which is the height of the envelope flap at a lateral displacement of ¾-inch from either edge, and which is used for purposes discussed below. If at 651 an envelope has not been detected and been displaced ¾-inch, then the process proceeds to test 652 where it is determined if five seconds have elapsed since the last envelope was detected. This test distinguishes between situations in which a mailing machine has been idle for a relatively long period of time (and no envelopes have passed the flap sensor) and situations where there is instantaneously no envelope at the flap sensor, but the mailing machine is running and the next envelope in a mixed succession of envelopes is approaching. If at 652 five seconds have not elapsed, then the process returns to test 651. If at 652 five seconds have elapsed, then the process proceeds to step 653 where the nozzle is moved to the 1.5-inch initialization height. After the nozzle is moved to this height, the process returns again to test 651 and continues to wait for an envelope.

The pre-positioning process of the present invention makes use of the fact that a sensor for measuring envelope flap height is upstream of the nozzle in a mailing machine and therefore flap height information is acquired prior to the time when the flap is actually at the nozzle position. The pre-positioning process makes use of this previously-acquired flap height information and moves the nozzle, prior to the point in time when the flap is actually at the nozzle position, so as to give the nozzle extra time to respond to control signals. By anticipating the arrival of the envelope flap, the pre-positioning process allows the nozzle to begin moving early so that it arives at the initial flap height when the flap arrives at the lateral position of the nozzle. This process allows the nozzle to more closely track the actual envelope flap profile than in moisteners which do not make use of previously-acquired flap height information.

Figure 6B:
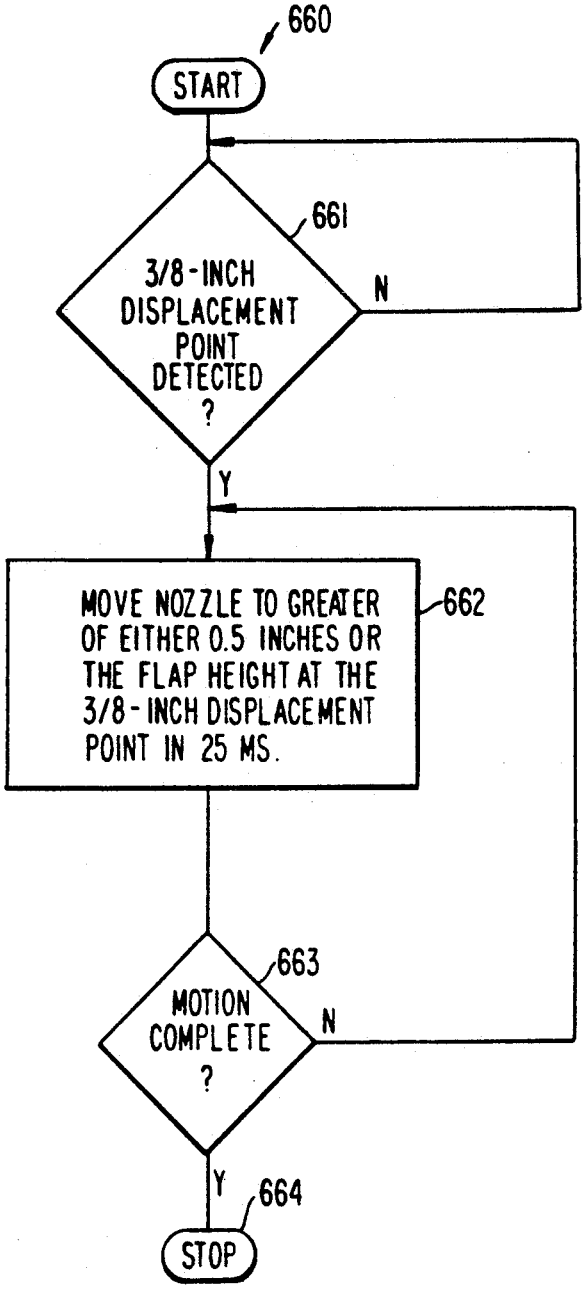
FIG. 6B is a flow diagram of an embodiment of the nozzle pre-positioning process according to the present invention.

The pre-positioning process of the present invention is diagrammed in FIG. 6B. The process starts at test 661 where it is determined whether an envelope has been detected and has been displaced laterally ¾-inch from its leading edge. If not, then the process continues to loop around test 661 until that condition is satisfied. When an envelope has been detected and has been displaced ¾-inch from its leading edge, then the process moves on to step 662 where the system begins to move the nozzle to a position equal to the greater of either 0.5 inches or ¾-inch displacement height. During this step the nozzle is repositioned over a time period of at least 25 milliseconds wherein the nozzle may or may not reach the desired height depending on the distance that the nozzle must move and the particular nozzle motor employed. This time limit is a practical limitation imposed by the maximum speed of the nozzle motor and the distance the nozzle is to be moved, which may vary for different combinations of nozzle motors and nozzle distances to be moved. At test 663, it is determined whether the system has moved the nozzle to the position determined in test 662. If not, then the process loops back around to step 662 until the system has moved the nozzle to the desired flap height. The process then ends at step 664 when the nozzle motion is complete.

It should be pointed out that if the nozzle initialization process 650 is used in conjunction with the pre-positioning process 660 of the present invention then test 661 of pre-positioning process 660 would replace test 651 of initialization process 650. Under this condition, if an envelope had not been detected or had not been displaced ¾-inch from its leading edge, then instead of looping around until such a point has been detected as shown in test 661 of FIG. 6B, the combination process would first test 652 where it is determined whether five seconds has elapsed during the present time-out, and if not it would proceed to test 661.

The nozzle holding process of the present invention is used to hold a nozzle to a predetermined flap height (i.e., the greater of either 0.5 inches or the ¾-inch displacement height) after the nozzle has tracked an envelope flap profile and before the next envelope flap approaches the nozzle. The ¾-inch displacement height and the 0.5-inch height were chosen because it has been empirically determined that most envelope flaps are not gummed below a 0.5-inch height or within ¾-inch laterally from either its leading or trailing edge, although other measurements may be used. This process relies on the statistical likelihood that the next envelope to be moistened will be of the same flap size as the envelope just moistened. Because of the symmetry of most envelope flaps, the flap height at the end point is the same as that at the starting point. By holding the nozzle at the height, one avoids the unnecessary return of the nozzle to the rest height. After some interval during which the nozzle is held but no envelopes pass, the nozzle is returned to the intermediate rest position in accordance with initialization process 650. This holding process of the present invention reduces nozzle motor power consumption and also improves the moistening profiles of envelope flaps that are moistened.

Figure 6C:
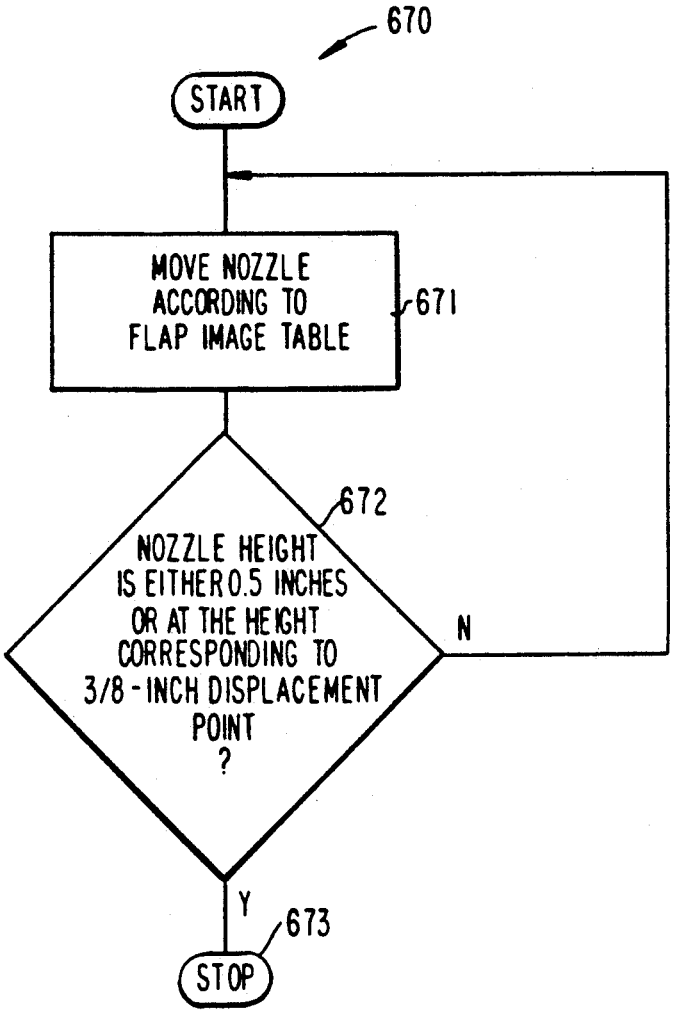
FIG. 6C is a flow diagram of an embodiment of the nozzle holding process according to the present invention.

The holding process of the present invention is diagrammed in FIG. 6C. Step 671 of the process moves the nozzle according to the flap profile table. As indicated above, for every 0.060 inch increment of motion of the envelope flap, the system moves the nozzle to begin to track the envelope flap profile, increment by increment, according to the flap image table. As the nozzle is tracking the envelope flap profile, test 672 determines if the nozzle height has reached either 0.5 inches or the ¾-inch displacement height which was determined in step 661 of pre-positioning process 660. If not, then the process loops back to step 671 where the system continues to move the nozzle to track the envelope flap profile, increment by increment, according to the flap image table. When test 672 determines that the nozzle height is either 0.5 inches or ¾-inch displacement height, then step 673 instructs the process to stop. At this step, the nozzle is therefore positioned at either 0.5 inches or at the ¾-inch displacement height.

Thus, an initialization process, a pre-positioning process and a holding process for use in controlling the movement of a nozzle in a moistener have been presented. While the invention has been discussed with reference to a limited number of embodiments, it will be apparent that variations and modifications may be made therein. For example, although a ¾-inch lateral displacement has been used to trigger the initialization process 650, other displacement points can be used as well. Furthermore, although initialization process 650 as illustrated in FIG. 6A uses five seconds as the rest period in test 652, other rest periods can be used as well. In addition, although step 661 of pre-positioning process 660 instructs the nozzle to be pre-positioned in 25 milliseconds, other time periods can be employed if they are compatible with the specific nozzle motor used. Furthermore, although steps 661 and 672 of pre-positioning process 660 and the holding process 670, respectively, use 0.5 inches as the minimum height as to which the nozzle will be positioned, other heights may be used if compatible with the particular types of envelopes being processed.

Figure 7:
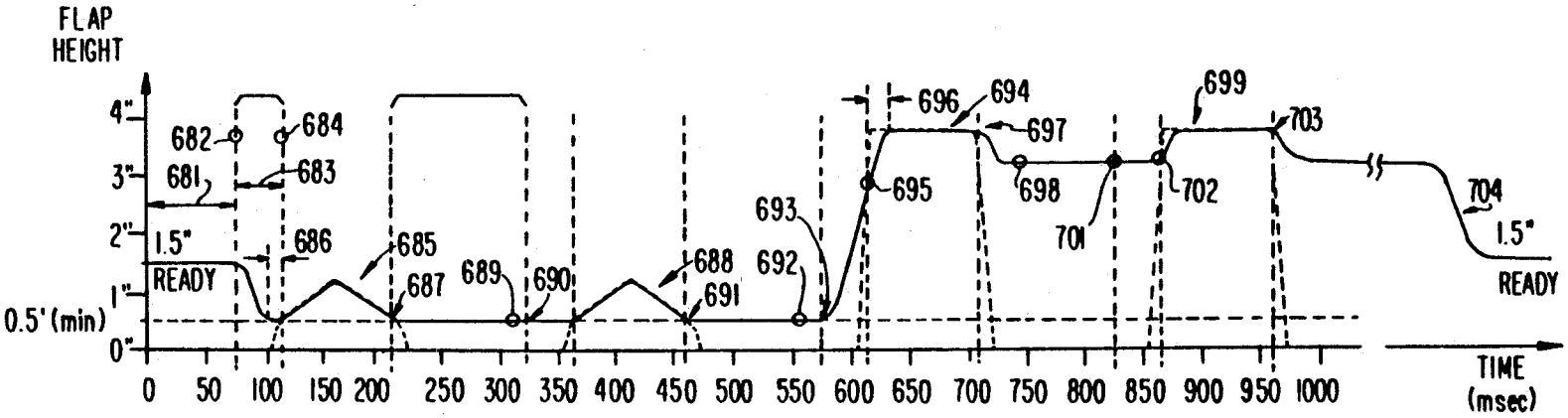
FIG. 7 illustrates the application of the methods diagrammed in FIGS. 6A-6C to the nozzle of a moistener of a mailing machine in connection with the same mixed succession of four envelope flaps depicted in FIG. 5.

FIG. 7 illustrates the application of the methods diagrammed in FIGS. 6A–6C to the nozzle of a moistener of a mailing machine in connection with the same mixed succession of four envelope flap depicted in FIG. 5. During time period 681, initialization process 650 is used to move the nozzle to a 1.5 inch rest height. With the nozzle positioned at 1.5 inches, it will be ready to be re-positioned to either larger or smaller heights when the first envelope approaches the moistener. At time point 682, the leading ¾-inch lateral displacement point of the first envelope flap 685 has been detected and the pre-portioning process 660 is used to pre-position the nozzle.

For envelope flap 685, since the ¾-inch displacement height is less than 0.5 inches, then the system moves the nozzle to a height of 0.5 inches. In the preferred embodiment, since the nozzle 250 is 2.5 inches up-stream from flap profile sensor 105, there is enough time for nozzle 250 to reach the 0.5 inch minimum height before flap 685 reaches the nozzle. During this time period (shown as time period 686 in FIG. 7), the nozzle waits for the flap to arrive as process 660 ends (see step 664).

Holding process 670 is used to hold the nozzle to a predetermined height after the nozzle has tracked an envelope flap profile and before a subsequent envelope flap approaches the nozzle. After flap 685 has been tracked to the point where the flap height either falls below 0.5 inches (see time point 687) or the ¾-inch displacement height, the nozzle is held at this predetermined height as process 660 stops (see step 664).

As can be seen in FIG. 7, while the second envelope flap 688 is approaching the nozzle, the nozzle remains positioned (see time period 689) at the height that it was at after the first envelope flap 685 passed through the nozzle. Because envelope flap 688 is the same as flap 685, at time point 690 (corresponding to when the ¾-inch lateral displacement point of second envelope flap 688 has been detected by the flap array sensor), the nozzle does not have to be re-positioned (in accordance with steps 661 and 662 of pre-positioning process 660) prior to tracking second envelope flap 688. This results, on average, in a decrease in the temperature of the nozzle motor since the motor does not have to be operated as long. As discussed above, this can result in a savings in motor cost and an increase in motor lifetime. When second envelope flap 688 reaches the nozzle, the nozzle is instructed to again track the second envelope flap, in accordance with holding process 670, using the second envelope flap profile stored in memory, as discussed above.

After the trailing ¾-inch displacement point of the second envelope flap 688 passes the nozzle, the system positions the nozzle (see time point 691 and time period 692 in FIG. 7) at the last height that it was left at (i.e., the lesser of either 0.5 inch or the ¾-inch displacement height; see step 672 of holding process 670). At time point 693, flap array sensor has determined the ¾-inch displacement height of the third envelope flap 694 and therefore, in accordance with pre-positioning process 660 of FIG. 6A, the system moves the nozzle toward the greater of either 0.5 inches or the ¾-inch displacement height (see step 662 in pre-positioning process 660). In contrast to the situation involving first two envelope flaps 685 and 688, by the time the ¾-inch lateral displacement point of envelope flap 694 reaches the nozzle, the nozzle has not yet reached the desired flap height (see time point 695 in FIG. 7). However, within a short period of time (see time period 696) the nozzle does track the actual flap profile.

For envelope flap 694, since the ¾-inch displacement height is greater than 0.5 inches, when the trailing ¾-inch lateral displacement point is reached (see time point 697) the nozzle is held at this position (see time period 698) until the fourth envelope flap 699 reaches the nozzle. When the ¾-inch lateral displacement point of the fourth envelope flap 699 is detected (see time point 701) the nozzle does not have to be re-positioned since the flap height has not changed from the corresponding height on the third envelope flap 694. At time point 702, when the ¾-inch lateral displacement point of envelope flap 699 reaches the nozzle, the nozzle is moved to track the flap profile stored in memory. Upon reaching the trailing ¾-inch lateral displacement point at time 703, the nozzle is held at this point until another envelope is moved through the flap profile sensor/nozzle. As was the case with the second envelope flap 688, because the nozzle does not have to be re-positioned, a decrease in average temperature of the nozzle motor can be achieved, and envelope flap 699 is tracked more closely than envelope flap 694 (compare moistened flap profiles of envelope flaps 603 and 604 in FIG. 5 with the corresponding profiles of envelope flaps 694 and 699 in FIG. 7).

In accordance with initialization process 650 in FIG. 6A, 5 seconds after the trailing ¾-inch lateral displacement point of the last envelope flap moves through the moistener of the present invention, the nozzle is moved to the initialization height of 1.5 inches (see time period 704 in FIG. 7) while the nozzle is waiting for another mixed succession of envelope flaps to be moved through the moistener. For a second mixed succession of envelope flaps, the processes discussed above can be repeated as desired.

Although the present invention was discussed above in detail with reference to the embodiment of the mailing machine shown in FIG. 3, it is to be understood that the present invention can be employed with a variety of other embodiments of mailing machine. Accordingly, one skilled in the art will appreciate that the present invention can be practiced by other than the described embodiments, which are presented for purposes of illustration and not of limitation, and that the present invention is limited by only the claims that follow.

What is claimed is:

1. A method for controlling movement of a nozzle in a moistener, said moistener being for moistening an envelope flap glue area of each envelope flap of a mixed succession of envelopes at a minimum time interval between envelopes, respective ones of said envelopes having envelope flaps of different height profiles randomly ordered, each of said envelope flaps having a first end and a second end, each of said height profiles having a terminal height adjacent said first and second ends, said moistener having said nozzle at a fixed lateral position, conveyer means for moving said envelope flaps in a downstream direction, a sensor upstream of said nozzle for measuring the heights of respective ones of said envelope flaps, means for moving said nozzle in the direction of said heights of said envelope flaps and means for measuring movement of said envelope flaps by said conveyer; said method comprising the steps of:

(a) moving an envelope flap past said sensor and measuring said height of said envelope flap at points laterally along said envelope flap;

(b) before a first point to be moistened on said envelope flap reaches said lateral position of said nozzle, moving said nozzle toward said height of said first point to be moistened;

(c) when said first point to be moistened reaches said nozzle, moistening said first point of said envelope flap;

(d) thereafter, until said second end reaches said nozzle, after moistening each point to be moistened, moving said nozzle to a height corresponding to a subsequent point to be moistened;

(e) after said second end passes said lateral position of said nozzle, and said nozzle is at a height corresponding to a point most recently moistened, said nozzle remains at said height corresponding to said point most recently moistened; and, (f) repeating step (a) for a next of said envelopes and steps (b) through (f) only if said next of said envelope's flap height differs from the just moistened envelope's flap height, otherwise repeat steps (a) through (f) skipping step (b).

2. The method of claim 1 further comprising an intermediate step (f) (1) prior to repeating step (a) of timing a interval until the next envelope flap is presented to said sensor and if said time interval exceeds said minimum time interval terminating said method; otherwise proceed.

3. The method of claim 2 further comprising the intermediate step (f) (2) of positioning said nozzle after said minimum time interval to a rest height greater than a smallest one of said terminal heights and less than a largest one of said terminal heights prior to method termination.

4. The method of claim 1 further comprising the intermediate step of:

(e) (1) moving said nozzle to a rest height greater than the smallest one of said terminal heights and less than a largest one of said terminal heights if a next envelope flap height differs from the just moistened envelope flap height at step (e).

* * * * *